US007896471B2

(12) United States Patent
Kobayashi

(10) Patent No.: US 7,896,471 B2
(45) Date of Patent: Mar. 1, 2011

(54) RECORDING HEAD AND METHODS FOR MANUFACTURING AND INSPECTING THE RECORDING HEAD

(75) Inventor: Isao Kobayashi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 578 days.

(21) Appl. No.: 11/974,790

(22) Filed: Oct. 16, 2007

(65) Prior Publication Data

US 2008/0088672 A1 Apr. 17, 2008

(30) Foreign Application Priority Data

Oct. 17, 2006 (JP) ..... 2006-282937

(51) Int. Cl.
*B41J 2/14* (2006.01)

(52) U.S. Cl. ..... 347/50; 347/57; 347/58; 347/59

(58) Field of Classification Search ..... 347/57–59, 347/50

See application file for complete search history.

(56) References Cited

U.S. PATENT DOCUMENTS 5,670,998 A * 9/1997 Shimoda et al. ..... 347/50
6,137,509 A * 10/2000 Hayasaki ..... 347/59
6,540,313 B2 * 4/2003 Suzuki ..... 347/5
6,604,817 B2 8/2003 Isono et al.
2005/0253488 A1 11/2005 Ito

FOREIGN PATENT DOCUMENTS

JP 2002-160372 6/2002
JP 2005-313428 11/2005
JP 2005-322850 11/2005
JP 2001-246744 9/2007

* cited by examiner

*Primary Examiner*—Ryan Lepisto
*Assistant Examiner*—Guy G Anderson
(74) *Attorney, Agent, or Firm*—Frommer Lawrence & Haug LLP

(57) ABSTRACT

A recording head includes: an actuator having a plurality of operable portions operable to cause the recording head to perform a recording; a drive circuit for driving the operable portions of the actuator; a wiring member on which the drive circuit is mounted, which is joined to the actuator, and which has a plurality of conductor wires including a first common voltage wire connected to a common voltage portion of the actuator that is common to the operable portions and a second common voltage wire connected to a common voltage portion of the drive circuit. The recording head further includes (A) a conductor for establishing, in an outer surface of the wiring member, an electrical conduction between the first common voltage wire and the second common voltage wire, or (B) conducting means for establishing, in the outer surface of the wiring member, the electrical conduction between the first and second common voltage wires. Also disclosed are methods for manufacturing and inspecting the recording head.

18 Claims, 11 Drawing Sheets

RECORDING HEAD AND METHODS FOR MANUFACTURING AND INSPECTING THE RECORDING HEAD

CROSS REFERENCE TO RELATED APPLICATION

The present application claims priority from Japanese Patent Application No. 2006-282937, which was filed on Oct. 17, 2006, the disclosure of which is herein incorporated by reference in its entirety.

BACKGROUND OF THE INVENTION

1. Field of the Invention

The present invention relates in general to a recording head, and more particularly to a recording head configured such that external signals are inputted thereto using a flexible wiring member, and to methods for manufacturing and inspecting the recording head.

2. Discussion of Related Art

As a recording apparatus configured to perform recording by ejection of ink from a recording head onto a recording medium, there has been known a recording apparatus disclosed in a Patent Document 1 (JP-A-2002-160372, in particular, FIGS. 4 and 6). In the disclosed recording apparatus, an external signal source and the recording head are connected to each other by a flexible wiring member on which is mounted a drive circuit, and signals supplied from the external signal source are inputted to the recording head via a drive circuit, so that the ink is ejected selectively from nozzles of the recording head, thereby performing the recording.

In a case where an actuator included in the recording head is, for example, a piezoelectric actuator as disclosed in the Patent Document 1, etc., voltage for polarizing may be applied to the piezoelectric actuator using the flexible wiring member after the flexible wiring member is connected to the piezoelectric actuator, thereby polarizing portions of a piezoelectric layer of the piezoelectric actuator which are to function as operable portions.

More specifically described, there are provided a shift register, a D flip-flop, a driver, etc., in the drive circuit mounted on the flexible wiring member disclosed in the Patent Document 1. The flexible wiring member includes conductor wires (i.e., lines) VDD1, VSS1, VDD2, VSS2 that are connected to the drive circuit. The conductor wires (i.e., lines) VSS1, VSS2 are connected to a common voltage portion of the drive circuit, and are normally grounded. Further, the flexible wiring member includes a conductor wire (i.e., line) VSS3 which is commonly connected to a common electrode (a common voltage portion) of one of piezoelectric deformable portions (each as the operable portion).

When polarizing, in a manufacturing process, the piezoelectric actuator of the recording head which has been assembled, a device constituted by a circuit and a power source (that are equivalent of a circuit and a power source that are used for ejecting the ink) is connected to the conductor wires VDD1, VSS1, VDD2, VSS2, etc., of the flexible wiring member, and a polarizing device is connected to the conductor wire VSS3. Then, voltage of V1 is applied from the conductor wire VDD2 to the operable portions of the actuator via the drive circuit, and in addition, minus voltage V2 is applied to the conductor wire VSS3, so that total voltage of (V1+V2) is applied to the operable portions, thereby polarizing the piezoelectric actuator. When the ink ejection is performed after the polarization has been completed, the conductor wires VSS2, VSS3 are connected to each other via another conductor wire so as to be kept at almost the same voltage with each other, e.g., at zero voltage or a ground.

In a case where the flexible wiring member is connected to the piezoelectric actuator by soldering after the piezoelectric actuator has been polarized, a polarized condition of the piezoelectric actuator may be deteriorated due to a heat generated by the soldering. However, in the recording apparatus disclosed in the Patent Document 1, the polarization is performed after the flexible wiring member has been connected to the recording head, thereby maintaining a good polarized condition of the piezoelectric actuator.

SUMMARY OF THE INVENTION

There may be a need to inspect the recording head that is ready for ejecting the ink after completion of the polarization, for example, by measuring an electrostatic capacity of the piezoelectric actuator and a value of resistance between the respective operable portions. In this instance, if the conductor wire VDD2 connected to the common voltage portion of the drive circuit and the conductor wire VDD3 connected to the common voltage portion of the actuator that is common to the operable portions are joined to each other, a characteristic of the piezoelectric actuator could not be reliably detected because an electrical current via the drive circuit is measured in the detection.

A problem similar to the above-described problem is also occurred in a different-type recording head having a drive circuit. In this recording head, a characteristic of each of a plurality of operable portions could not be reliably detected, either.

The present invention has been developed in view of the background discussed above. It is therefore an object of the present invention to provide a recording head in which a characteristic thereof can be reliably and finely detected, and to provide methods for manufacturing and inspecting the recording head.

A recording head according to a first aspect of the present invention includes: an actuator including a plurality of operable portions operable to cause the recording head to perform a recording; a drive circuit configured to drive the plurality of operable portions of the actuator; a wiring member on which the drive circuit is mounted, which is joined to the actuator, and which has a plurality of conductor wires including a first common voltage wire connected to a common voltage portion of the actuator that is common to the plurality of operable portions and a second common voltage wire connected to a common voltage portion of the drive circuit. The recording head according to the first aspect of the present invention further includes: one of (A) a conductor configured to establish, in an outer surface of the wiring member, an electrical conduction or connection between the first common voltage wire and the second common voltage wire; and (B) conducting means configured to establish, in the outer surface of the wiring member, the electrical conduction between the first common voltage wire and the second common voltage wire.

Further, a method for inspecting the recording head in accordance with a second aspect of the present invention is applied to the recording head in which said one of the conductor and the conducting means is configured such that the electrical conduction between the first common voltage wire and the second common voltage wire is breakable, where necessary, the method including: breaking the electrical conduction between the first common voltage wire and the second common voltage wire established by said one of the conductor and the conducting means; detecting a characteristic of the actuator via the first common voltage wire after the electrical conduction is broken, so as to inspect the recording head; and establishing, by said one of the conductor and the conducting means, the electrical conduction between the first common voltage wire and the second common voltage wire in the wiring member after the characteristic of the actuator is detected.

Further, a method for manufacturing the recording head in accordance with a third aspect of the present invention includes: preparing the wiring member which is joined to the actuator and without the electrical conduction being established in the wiring member; polarizing the plurality of operable portions of the actuator by applying a voltage via the first common voltage wire for the wiring member which has been prepared; and establishing, by said one of the conductor and the conducting means, the electrical conduction between the first common voltage wire and the second common voltage wire in the wiring member after the polarization has been performed.

According to the present invention, in a state in which the first common voltage wire and the second common voltage wire is not connected to each other, the inspection can be performed without an influence of the drive circuit, or the polarization can be appropriately performed on the plurality of operable portions of the actuator. Then, after the inspection or the polarization is performed, the electrical conduction between the first common voltage wire and the second common voltage wire can be established in a convenient manner. Consequently, in a state in which the electrical conduction between the first common voltage wire and the second common voltage wire is established, recording can be appropriately performed by the recording head.

BRIEF DESCRIPTION OF THE DRAWINGS

The above and optional objects, features, and advantages of the present invention will be better understood by reading the following detailed description of preferred embodiments of the invention when considered in conjunction with the accompanying drawings, in which.

DETAILED DESCRIPTION OF THE PREFERRED EMBODIMENTS

Figure 1:
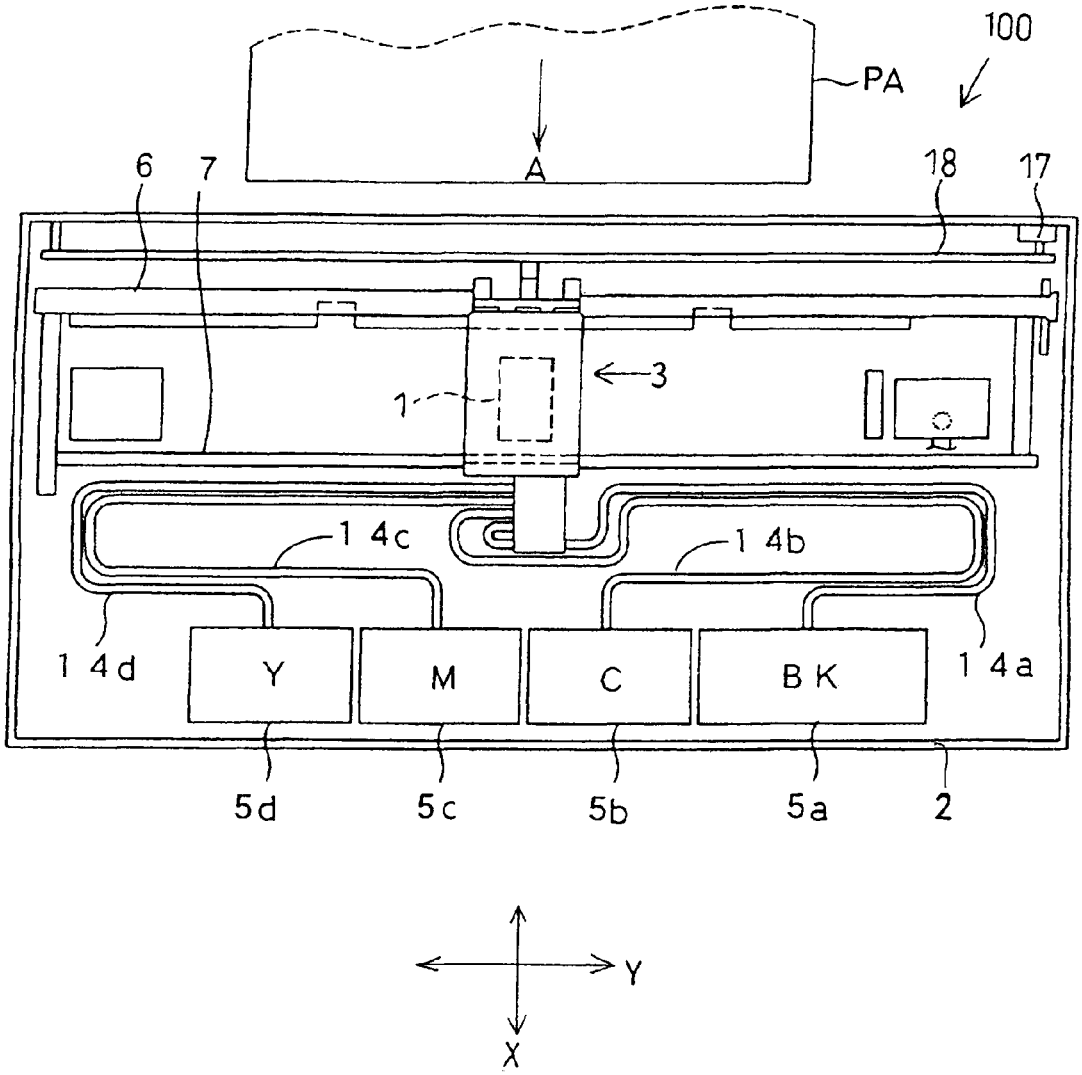
FIG. 1 is a plan view showing an ink-jet recording apparatus equipped with a recording head as an embodiment of the present invention.

Hereinafter, there will be described a preferred embodiment of the present invention by reference to the drawings. FIG. 1 shows an ink-jet recording apparatus 100 having a recording head as an embodiment of the present invention. The ink-jet recording apparatus 100 is utilized, for instance, not only as an independent printer device, but also as a printer function of a Multi Function Device (MFD) with a copier function, a scanner function, a facsimile function, etc. Inside a body frame 2 of the ink-jet recording apparatus 100, there is disposed a carriage 3 equipped with a recording head 1 which performs recording by ejection of ink onto a sheet PA as a recording medium.

In the body frame 2, the carriage 3 is slidably held on or supported by a rear guide shaft 6 and a front guide shaft 7 which are disposed in parallel with each other so as to extend in a main scanning direction of the carriage 3, i.e., in a Y direction shown in FIG. 1. The carriage 3 is configured to reciprocate in the main scanning direction, i.e., in the Y direction, by a carriage-driving motor 17 disposed at a right rear portion of the body frame 2 as seen in FIG. 1 and a timing belt 18 as an endless belt. Inks are supplied from respective ink supply sources (i.e., ink tanks) 5*a*, 5*b*, 5*c*, 5*d* which are statically disposed in the body frame 2 toward the carriage 3 via respective ink supply tubes 14*a*, 14*b*, 14*c*, 14*d*. In this ink-jet recording apparatus, there are respectively accommodated, in the respective ink tanks 5*a* through 5*d*, inks of four colors, e.g., a yellow ink (Y), magenta ink (M), a cyan ink (C), and a black ink (Bk).

The sheet PA is horizontally fed by a known sheet-feeding mechanism (not shown) below a lower surface of the recording head 1 in a sub scanning direction (i.e., an X direction or a direction indicated by an arrow A shown in FIG. 1) perpendicular to the main scanning direction or the Y direction. The inks are ejected downward onto the sheet PA from a plurality of nozzles (not shown) which are open in the lower surface of the recording head 1 that is moved in the main scanning direction or the Y direction, whereby the recording is performed. In the following description, a side or a surface of each component of the ink-jet recording apparatus 100 which is nearer to a side or a surface of the recording head 1 in which the nozzles are open (i.e., nozzle-opening surface or side of the recording head 1) is referred to as a front or lower side or a front or lower surface of each component, while a side or a surface of each component which is remote from the nozzle-opening surface or nozzle-opening side of the recording head 1 is referred to as a back or upper side or a back or upper surface of each component.

Figure 2:
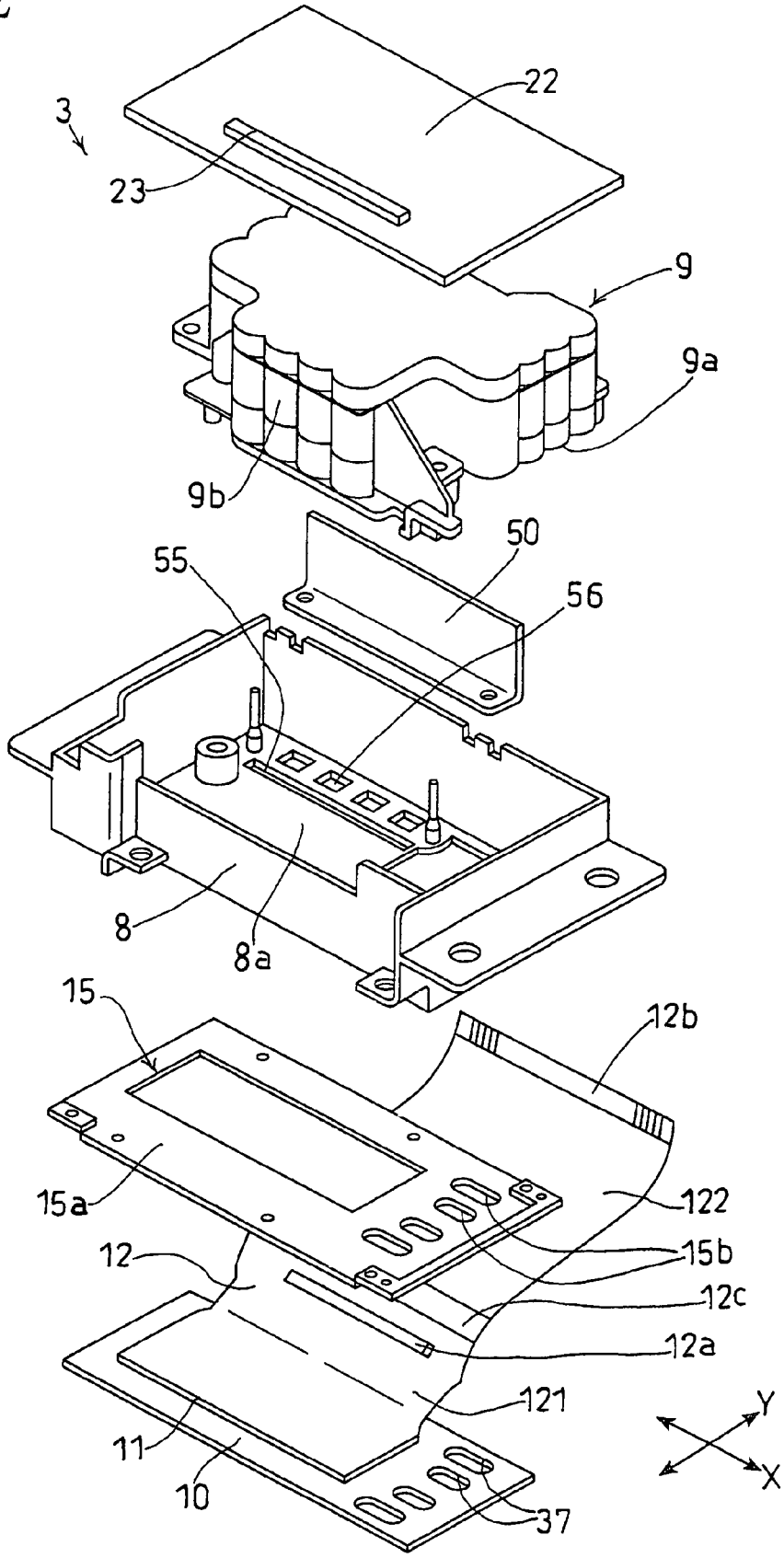
FIG. 2 is an exploded perspective view of a carriage holding the recording head.
Figure 3:
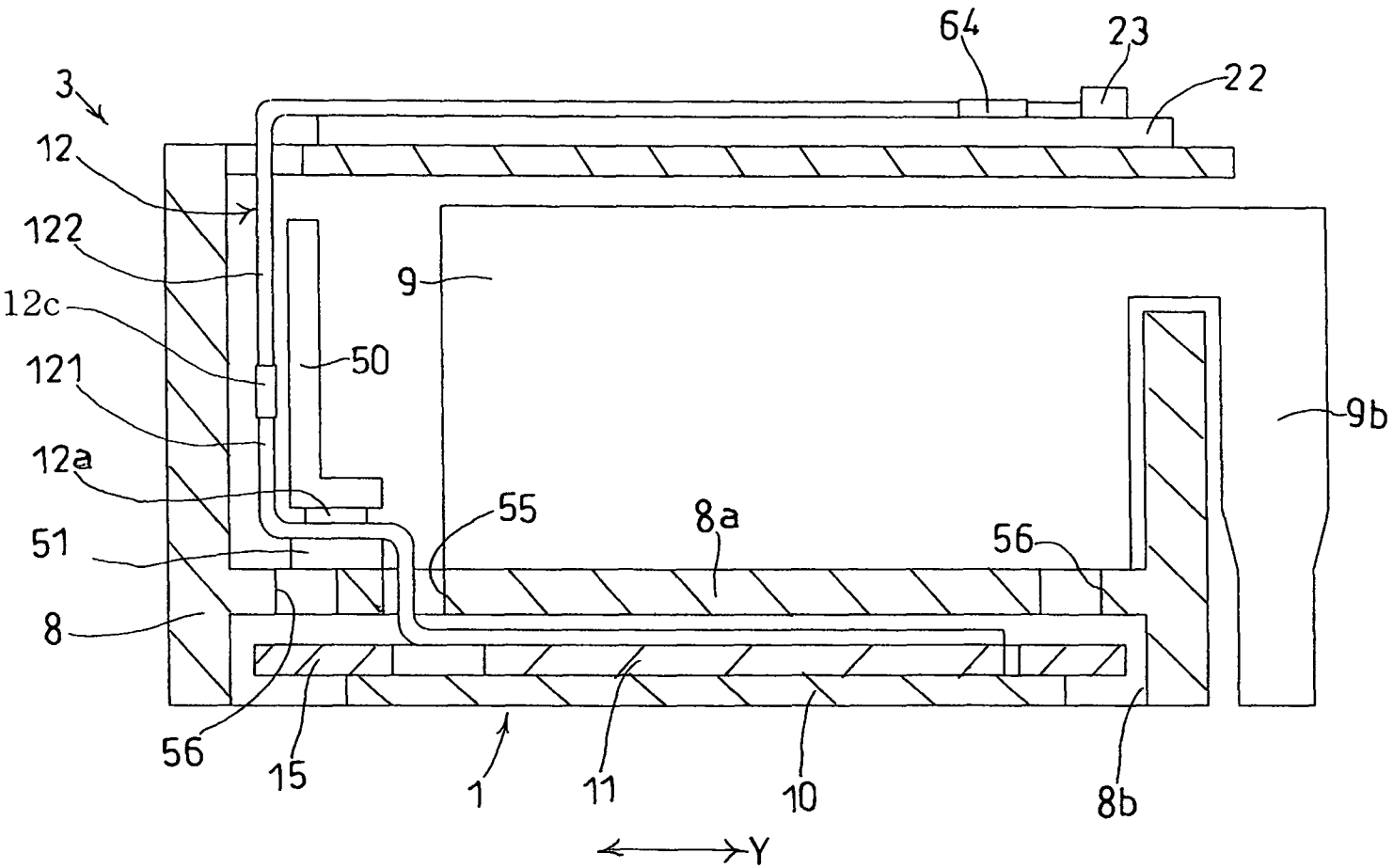
FIG. 3 is a cross-sectional schematic view showing a cross section of the carriage, taken in a plane parallel to a Y direction.

As shown in FIGS. 2 and 3, the carriage 3 includes a head holder 8 having a generally box-like shape which is open upward. On a lower side of a bottom plate 8*a* of the head holder 8, a recessed portion 8*b* is formed so as to be open downward. The recording head 1 is fixedly accommodated in the recessed portion 8*b* such that the nozzles are exposed downward and such that the recording head 1 is kept in a posture substantially parallel to the bottom plate 8.

Figure 10:
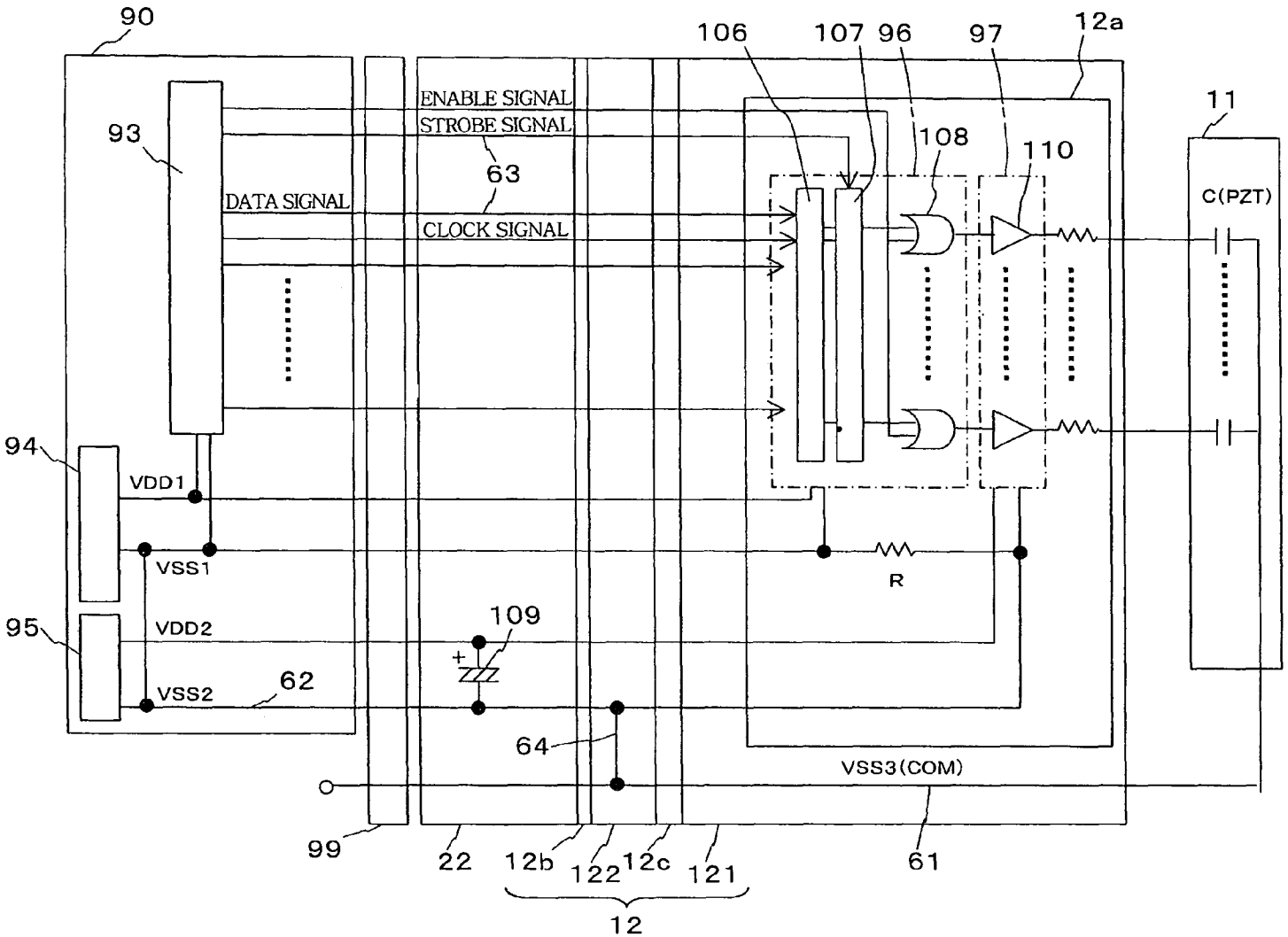
FIG. 10 is a diagram showing an example of an electrical circuit applied to the ink-jet recording apparatus.

On a back side of the head holder 8, there is disposed a head-side circuit board 22 on which is formed an electrical circuit that is electrically connected to a body-side circuit board 90 disposed in the body frame 2. The head-side circuit board 22 is connected to an external signal source via a flexible wiring member 99. The body-side circuit board 90 and the flexible wiring member 99 are shown in FIG. 10. The head-side circuit board 22 is disposed at a position where the head-side circuit board 22 overlaps the recording head 1 in a plan view when viewed from the back side of the head holder 8.

Figure 4:
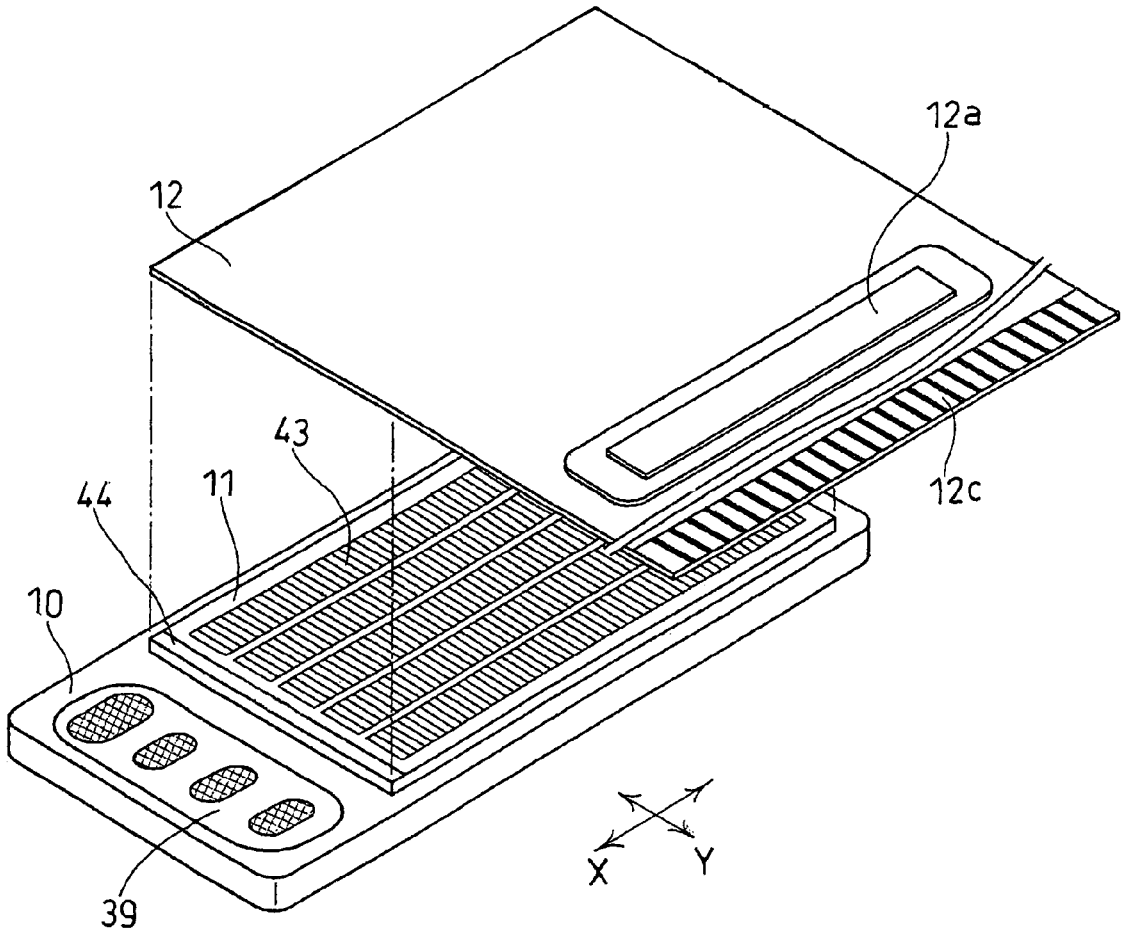
FIG. 4 is an exploded perspective view of the recording head.

On an upper side of the bottom plate 8*a* of the head holder 8, there is disposed, between the recording head 1 and the head-side circuit board 22, a damper device 9 which stores the inks that have been supplied toward the carriage 3. An inner space of the damper device 9 is divided into a plurality of ink chambers in which are respectively stored the inks of different colors that have been supplied via the respective ink supply tubes 14*a* through 14*d*. The damper device 9 has: air-discharging valve means 9*b* which is for removing air bubbles remaining in the inks stored in the respective ink chambers; and ink outlets 9*a* through which the inks are supplied to the recording head 1. An opening (not shown) is formed through the bottom plate 8*a* of the head holder 8. As shown in FIGS. 2 and 4, inside the opening, the ink outlets 9*a* of the damper device 9 are connected to respective ink inlets 37 formed in the recording head 1 via respective connecting holes 15*b* formed in a reinforcing frame 15, whereby the inks of the different colors are supplied independently of each other from the damper device 9 to the recording head 1.

As shown in FIGS. 2 and 3, there is formed, through the bottom plate 8*a* of the head holder 8*a*, a slit 55 through which a flexible wiring member 12 of the recording head 1 is inserted from a front side of the bottom plate 8*a* to a back side thereof. The flexible wiring member 12 passes through the slit 55, extends upward along an inner surface of a side wall of the head holder 8, and is connected to a connector 23 provided on the head-side circuit board 22. The bottom plate 8*a* is further formed with through-holes 56 through which an adhesive agent is poured for fixing the recording head 1 to the front side of the bottom plate 8*a*. Further, a later-described drive IC chip 12*a* is mounted on the flexible wiring member 12. On the upper side of the bottom plate 8*a*, there is disposed a radiator 50 which has a L-shape as seen in a side view and which is held in close contact with the drive IC chip 12*a*. The drive IC chip 12*a* is biased by a rubber-like elastic member 51 via the flexible wiring member 12 toward the radiator 50, whereby a heat generated in the drive IC chip 12*a* can be reliably radiated. The flexible wiring member 12 and the drive IC chip 12*a* will be explained in greater detail.

The recording head 1 has a laminar structure in which a cavity portion 10, the piezoelectric actuator 11 and the flexible wiring member 12 are stacked on each other. The cavity portion 10 includes the plurality of nozzles which are open in its lower surface and ink channels which are formed therein. The piezoelectric actuator 11 applies an ejection pressure to the ink in the cavity portion 10. The flexible wiring member 12 includes a drive circuit which outputs a drive signal for selectively driving the piezoelectric actuator 11. Further, the reinforcing frame 15 is fixed on a back surface of the cavity portion 10.

Like known cavity portions disclosed in JP-A-2001-246744 and JP-A-2005-313428, for instance, the cavity portion 10 is configured such that the inks individually supplied to the corresponding ink inlets 37 which are exposed on an upper surface of the cavity portion 10 at its one of opposite end portions in the X direction are distributed, through the corresponding manifold chambers (not shown) in the cavity portion 10, into a plurality of pressure chambers (not shown). Operable portions of the piezoelectric actuator 11 are actuated to selectively apply the ejection pressure to the pressure chambers, whereby the inks are ejected from the nozzles communicating with the corresponding pressure chambers.

The piezoelectric actuator 11 in the present embodiment has a construction similar to that of a known actuator disclosed in JP-A-2005-322850, for instance. More specifically explained, the piezoelectric actuator 11 includes a plurality of ceramic layers which are stacked on each other in a direction perpendicular to planes thereof and inner electrodes (not shown) each sandwiched by and between adjacent two of the ceramic layers. In each of the ceramic layers, the operable portions are formed such that each active portion is located in an area of the ceramic layer vertically interposed between adjacent two of the inner electrodes. Described in detail, the inner electrodes include inner individual electrodes corresponding to the respective pressure chambers and inner common electrodes each common to the plurality of pressure chambers. Accordingly, one operable portion is formed in an area of each ceramic layer vertically interposed between one inner individual electrode and a corresponding portion of one inner common electrode. As shown in FIG. 4, there are formed, on an upper surface of the piezoelectric actuator 11, external individual terminals 43 connected to the respective inner individual electrodes via respective electric through holes and an external common terminal 44 connected to the inner common electrodes. The operable portions are deformed by drive pulse signals applied to the corresponding external individual terminals 43 via the drive circuit, whereby the ejection pressure is selectively applied to the corresponding pressure chambers. The external individual terminals 43 and the external common terminal 44 are electrically connected to terminals (not shown) formed on the flexible wiring member 12.

The reinforcing frame 15 is for reinforcing the cavity portion 10 and is a frame-like member made of a material having a higher degree of rigidity than the cavity portion 10. For instance, the reinforcing frame 15 is provided by a metal plate formed of SUS. The reinforcing frame 15 has a size in its plan view somewhat larger than that of the cavity portion 10. The reinforcing frame 15 is superposed on and fixedly bonded to the back surface of the cavity portion 10 so as to surround the piezoelectric actuator 11, thus preventing deformation and distortion of the cavity portion 10 having a thin flat shape.

The flexible wiring member 12 is a flexible band-like cable for electrically connecting the above-described head-side circuit board 22 and the piezoelectric actuator 11 to each other. The flexible wiring member 12 is elongated in a direction in which a multiplicity of conductor wires formed thereon extend. The flexible wiring member 12 includes a first wiring member 121 and a second wiring member 122 which are arranged in a longitudinal direction of the flexible wiring member 12 and which are joined to each other. A back surface or a second surface of one of opposite end portions of the first wiring member 121 in a longitudinal direction thereof faces the piezoelectric actuator 11. The drive IC chip 12*a* having a drive circuit for driving the piezoelectric actuator 11 is mounted on the first wiring member 121 in a portion thereof extending from a portion which faces the piezoelectric actuator 11. One of the opposite end portions of the second wiring member 122 is joined to the first wiring member 121. On the other of the opposite end portions of the second wiring member 122, there is formed a terminal portion 12*b* which is connectable to the connector 23 of the head-side circuit board 22.

The flexible wiring member 12 includes conductor wires, e.g., first common voltage wires 61 (i.e., a later-described conductor line VSS3) each connected to the external common terminal 44 of the piezoelectric actuator 11, second common voltage wires 62 (i.e., a later-described ground conductor line VSS2) each connected to a common voltage portion of a later-described drive-voltage-signal generating circuit 97 of the drive IC-chip 12*a*, signal wires 63 for inputting, into the drive IC-chip 12*a*, various drive signals for recording, later-described conductor lines VDD1, VDD2, VSS1, and the like.

Figure 5:
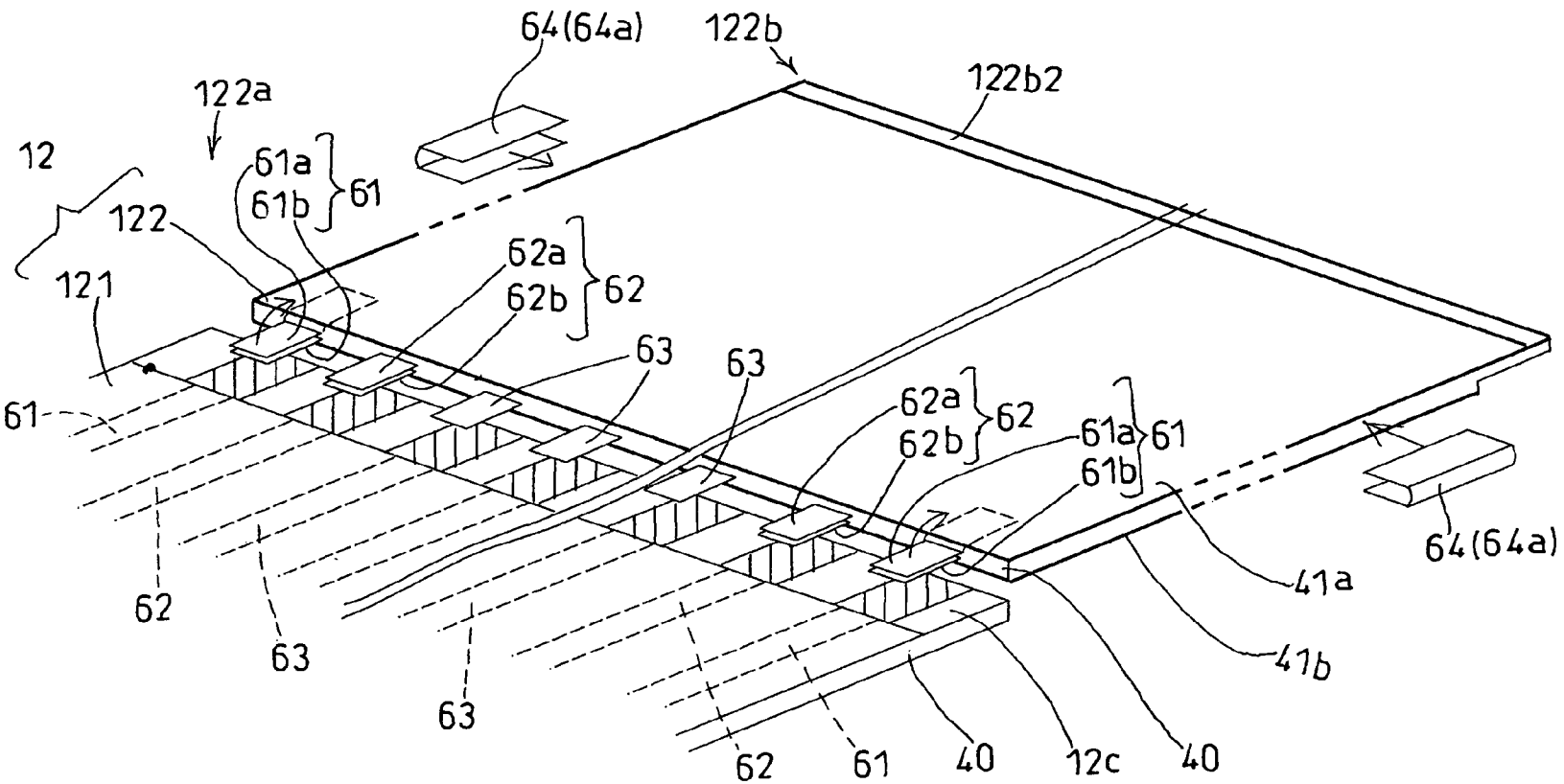
FIG. 5 is a perspective view schematically showing a portion of the recording head at which a first wiring member and a second wiring member thereof are joined to each other.

As shown in FIG. 5, the conductor wires including the first common voltage wires 61, the second common voltage wires 62, the signal wires 63 and the like are configured to extend in the longitudinal direction of the first and second wiring member 121, 122. Each first common voltage wire 61 is divided by two parts, i.e., a part disposed in the first wiring member 121 and another part disposed in the second wiring member 122, and these two parts are joined to each other at a joint portion 12*c* (see FIG. 5). Also, each second common voltage wire 62 is divided by two parts in the same manner as the first common voltage wire 61, and these two parts are joined to each other at the joint portion 12*c*. These conductor wires are disposed in a following manner: the first common voltage wires 61 are disposed at respective positions nearer to outermost opposite side end portions of the flexible wiring member 12 in a widthwise direction thereof; the second common voltage wires 62 are disposed inside and adjacent to the respective first common voltage wires 61 so as to extend along the opposite side end portions of the flexible wiring member 12; other conductor wires such as the signal wires 63 are arranged inside and interposed between the second common voltage wires 62.

The first wiring member 121 is configured by including band-like electrical insulating layer 40, later-described terminals (not shown) and the plurality of conductor wires 61, 62, 63. More specifically described, the electrical insulating layer 40 is made of a flexible synthetic resin material, e.g., a polyimide resin. On an upper surface of the electrical insulating layer 40, there are formed, by a photolithography, the terminals and the plurality of conductor wires 61, 62, 63. The terminals and the plurality of conductor wires 61, 62, 63 are covered by a cover lay (not shown) which is made of a synthetic resin material, e.g., the polyimide resin, and which has an electrical insulating properties and a flexibility.

Further, on the upper surface of the electrical insulating layer 40, there is mounted the drive IC-chip 12*a* to which the conductor wires are connected. On a back surface of the first wiring member 121 which faces the piezoelectric actuator 11, there are disposed the terminals (not shown) whose conductor wires are exposed at positions respectively corresponding to the external common terminal 44 and the external individual terminals 43 of the piezoelectric actuator 11. The first common voltage wires 61 and the conductor wires extending from an outputting side of the drive IC-chip 12*a* are appropriately bent and routed up to the corresponding terminals. In an upper side of the joint portion 12*c* at which the first and second wiring member 121, 122 are joined to each other, the conductor wires are exposed. As the first wiring member 121, there is employed a chip-on flexible flat cable (COF).

As shown in FIG. 5, the second wiring member 122 is a multi-purpose cable on which are formed, in parallel to each other at a constant pitch in a widthwise direction, a plurality of conductor wires (61, 62, 63, etc.) that are vertically sandwiched by the band-like electrical insulating layers 40 made of the flexible synthetic resin material (e.g., the polyimide resin). Further, as the second wiring member 122, there is employed a so-called shield flexible flat cable (shield FFC) in which the upper and lower electrical insulating layers 40 are respectively covered by conductive layers electrically independent of each other. On the upper and lower electrical insulating layers 40, there are respectively superposed first and second conductive layers 41*a*, 41*b*. The first and second conductive layers 41*a*, 41*b* are formed to include an aluminum foil and the like. Further, in the second wiring member 122, there is provided a conductor 64 for establishing an electrical conduction between the first and second conductive layers 41*a*, 41*b*. There will be more specifically described the conductor 64.

In the first wiring member 121, the conductor wires are provided in parallel to each other without overlapping in a plan view. However, in the second wiring member 122, each pair of the first common voltage wires 61 are vertically superposed on each other in a thickness direction of the second wiring member 122, and are held in contact so as to be electrically connected to each other. Further, in the second wiring member 122, each pair of the second common voltage wires 62 are vertically superposed on each other in a thickness direction of the second wiring member 122, and are held in contact so as to be electrically connected to each other. One of the first common voltage wires 61 which is provided in an upper side of the second wiring member 122 is referred to as an upper first common voltage wire 61*a*, and the other of the first common voltage wires 61 which is provided in a lower side of the second wiring member 122 is referred to as a lower first common voltage wire 61*b*. One of the second common voltage wires 62 which is provided in the upper side of the second wiring member 122 is referred to as an upper second common voltage wire 62*a*, and the other of the second common voltage wires 62 which is provided in the lower side of the second wiring member 122 is referred to as a lower second common voltage wire 62*b*.

Figures 7A, 7B, 7C:
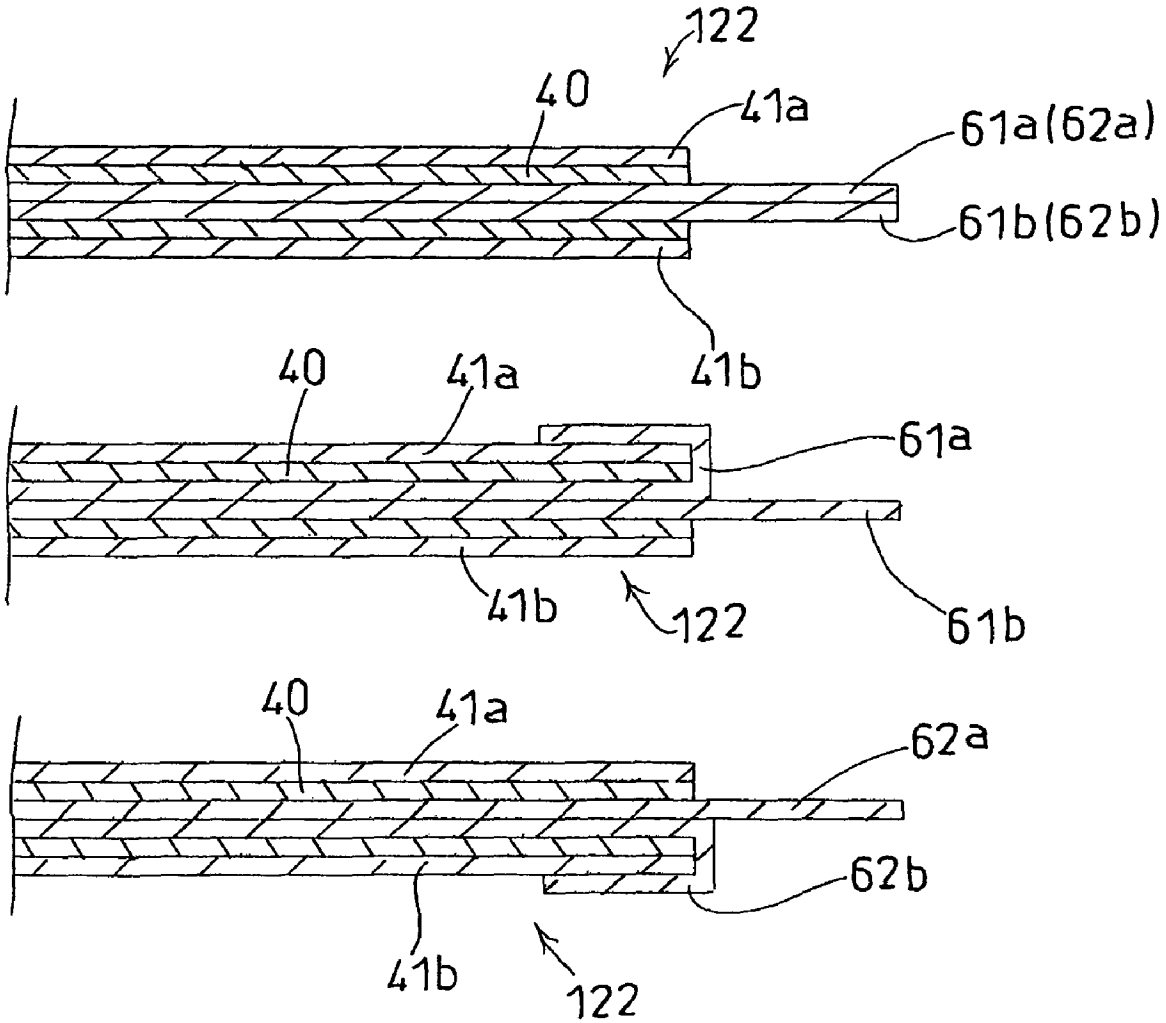
FIG. 7A is a cross sectional view showing a state in which the first and second common voltage wires of the second wiring member are not connected to a first and second conductive layers provided by the outer surface of the second wiring member.
FIG. 7B is a cross sectional view showing a state in which the first common voltage wire is connected to the first conductive layer.
FIG. 7C is a cross sectional view showing a state in which the second common voltage wire is connected to the second conductive layer.

As shown in FIG. 5, the first common voltage wires 61*a*, 61*b* are disposed in the above-described manner in which the two wires are vertically superposed on each other, at respective positions nearer to outermost opposite side end portions of the second wiring member 122 in a widthwise direction thereof. The second common voltage wires 62*a*, 62*b* are disposed inside and adjacent to the respective first common voltage wires 61*a*, 61*b*, and are vertically superposed on each other as the first common voltage wires 61*a*, 61*b*. Other conductor wires such as the signal wires 63 are disposed inside and interposed between the second common voltage wires 62*a*, 62*b*, without the signal wires 63 being vertically superposed on each other As shown in FIG. 7A, in the second wiring member 122, a first end 122*a* (as one of opposite end portions of the second wiring member 122) which is to be joined to the first wiring member 121 functions as a terminal in which the wires are exposed by removing the upper and lower electrical insulating layers 40. It is noted that FIG. 7 schematically shows a dimension of the second wiring member 122 in a thickness direction thereof.

Figure 8A:
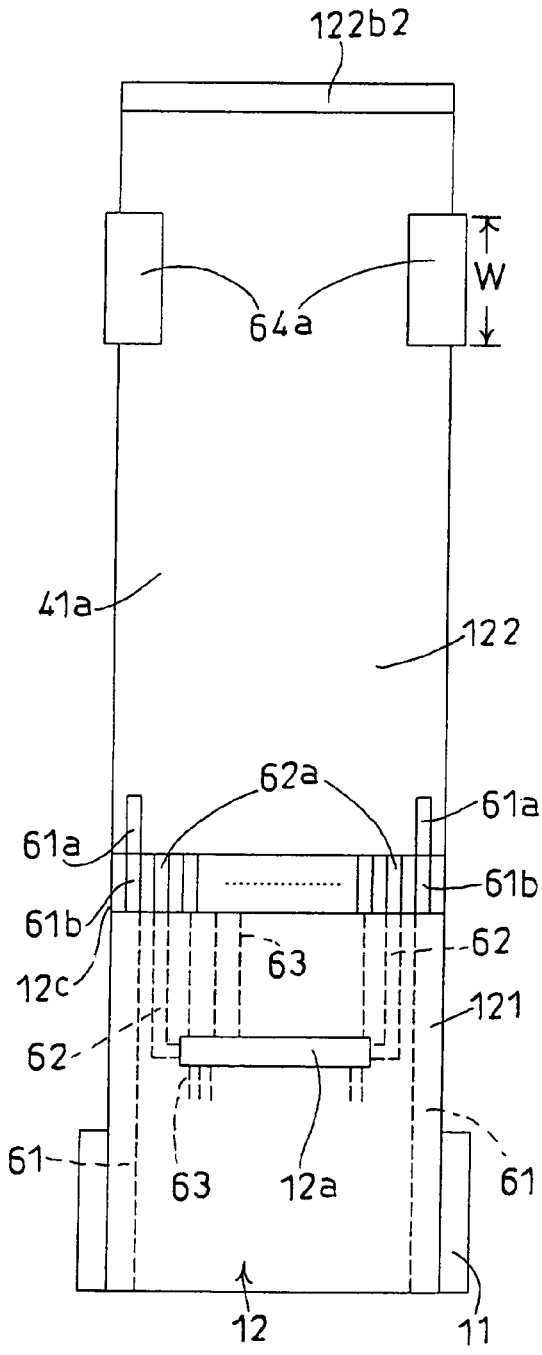
FIG. 8A is a plan view showing a first surface as one of opposite surfaces of a flexible wiring member constituted by the first and second wiring members.
Figure 8B:
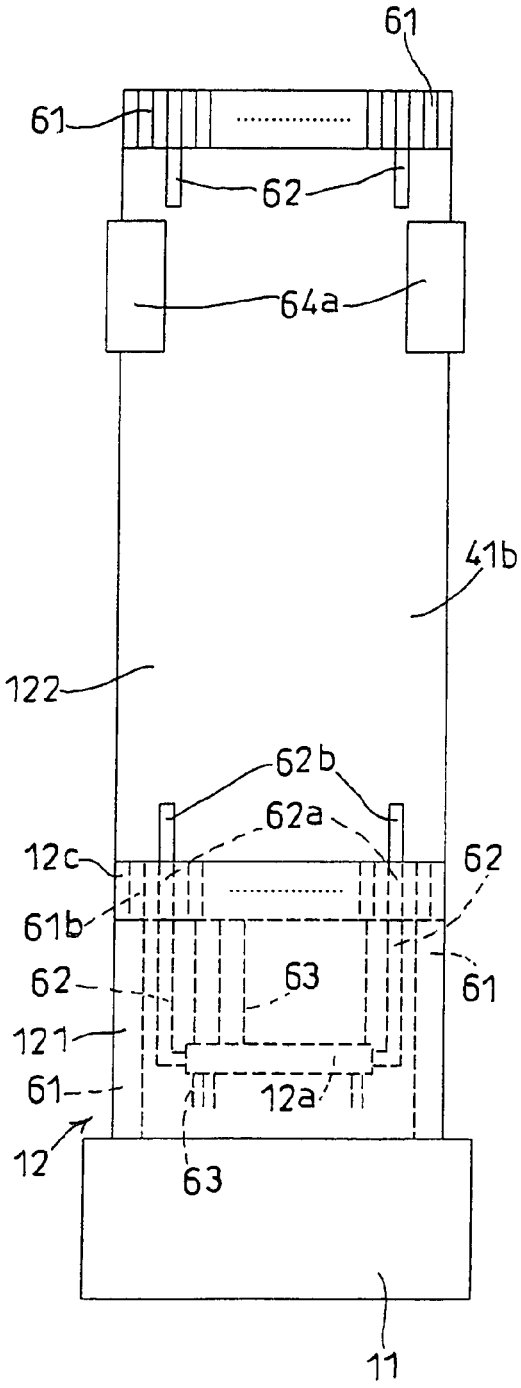
FIG. 8B is a plan view showing a second surface as the other of the opposite surfaces of the flexible wiring member.

As shown in FIGS. 5, 7B and 8A, in a terminal portion of each of the first common voltage wires 61 which is exposed toward the joint portion 12*c*, as one of the two wires vertically superposed on each other in the thickness direction, the upper first common voltage wire 61*a* provided in the upper side of the second wiring member 122 is exposed in the upper electrical insulating layers 40 and is bent so as to be overlapped with the first conductive layer 41*a*, whereby the upper first common voltage wire 61*a* is electrically connected to the first conductive layer 41*a*. As shown in FIGS. 7C and 8B, in a terminal portion of each of the second common voltage wires 62 which is exposed toward the joint portion 12*c*, as one of the two wires vertically superposed on each other in the thickness direction, the lower second common voltage wire 62*b* provided in the lower side of the second wiring member 122 is exposed in the lower electrical insulating layers 40 and is bent so as to be overlapped with the second conductive layer 41*b*, whereby the lower second common voltage wire 62*b* is electrically connected to the second conductive layer 41*b*.

As shown in FIGS. 5, 8A and 8B, it is noted that the lower first common voltage wire 61*b* provided in the lower side of the second wiring member 122 is electrically connected, without the wire 61*b* being bent, to a corresponding one of the first common voltage wires 61 of the first wiring member 121. The upper second common voltage wire 62*a* provided in the upper side is electrically connected, without the wire 62*a* being bent, to a corresponding one of the second common voltage wires 62 of the first wiring member 121. Other conductor wires including the signal wires 63 are electrically connected to other respective conductor wires including the signal wires 63 of the first wiring member 121.

Figure 6:
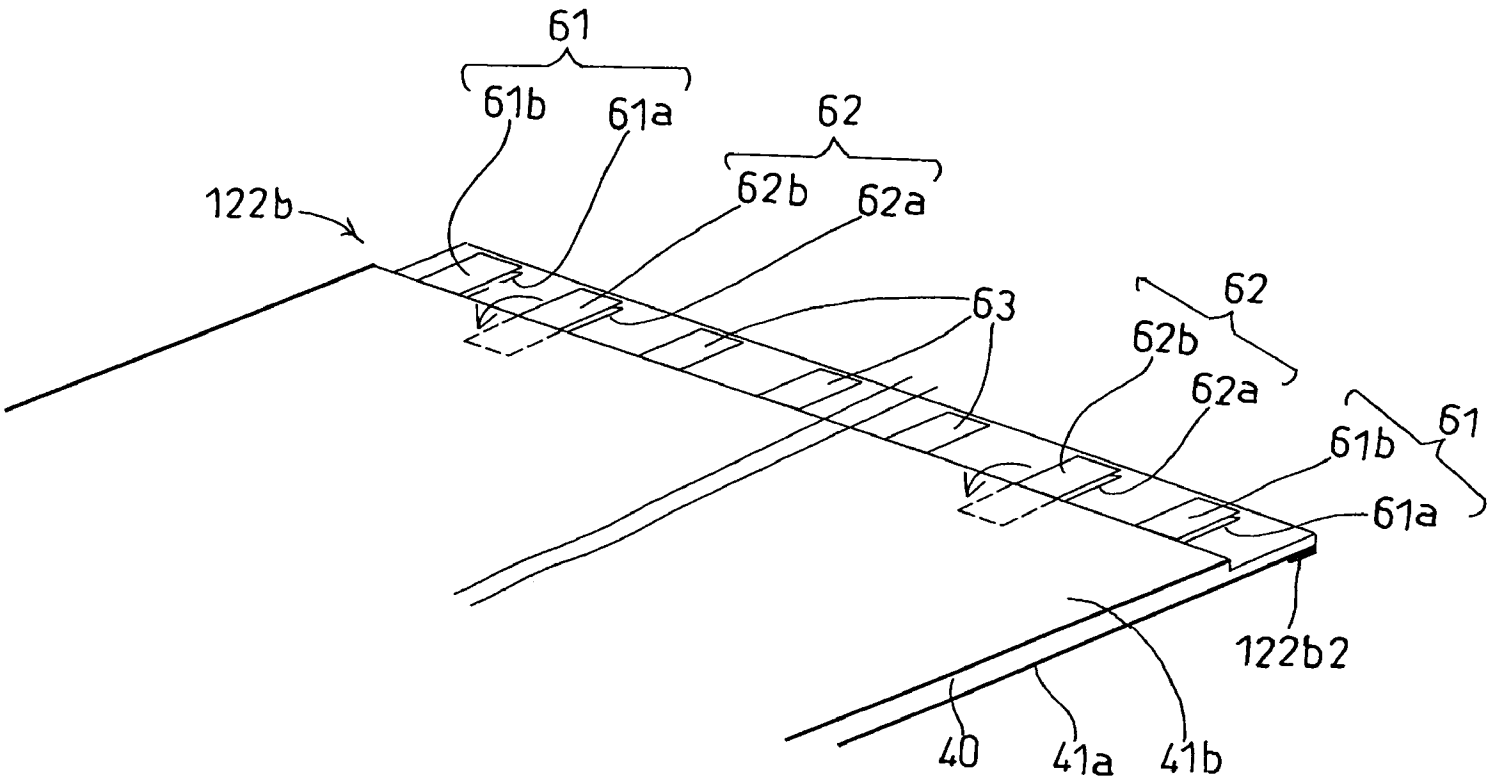
FIG. 6 is a perspective view schematically showing a portion of the second wiring member at which is joined to a connector.

As shown in FIG. 6, a second end 122*b* (as the other of opposite end portions of the second wiring member 122) which is to be joined to the connector 23 of the head-side circuit board 22 functions as a terminal in which the wires are exposed by removing only the lower electrical insulating layers 40. As shown in FIGS. 6 and 8B, in a terminal portion of each of the second common voltage wires 62 which is exposed in the other of opposite end portions of the second wiring member 122, as one of the two wires vertically superposed on each other in the thickness direction, the lower second common voltage wire 62*b* provided in the lower side of the second wiring member 122 is bent so as to be overlapped with the second conductive layer 41*b*, thereby being electrically connected thereto. The first common voltage wire 61, the upper second common voltage wire 62*a* provided in the upper side and other respective conductor wires including the signal wires 63 are electrically connected, without them being bent, to respective terminals provided in the connector 23 so as to be connectable thereto and disconnectable therefrom.

A reinforcing member 122*b* is adhered to an upper surface of the second end 122*b* of the second wiring member 122, thereby facilitating a handling of the second end 122*b* when the same 112*b* is to be connected to the connector 23. The above-described portion (which is bent) of each of the upper and lower first common voltage wires 61*a*, 61*b* and the upper and lower second common voltage wire 62*a*, 62*b* provides as an exposed portion that is exposed in the outer surface of the wiring member 12.

On the upper and lower surfaces of the second wiring member 122, the first and second conductive layers 41*a*, 41*b* are electrically independent of each other. In the present embodiment, as the conductor 64 for establishing or breaking the electrical conduction between the first conductive layer 41*a* provided on the upper surface and the second conductive layer 41*b* provided on the lower surface, there is adopted a conductive tape 64*a* (i.e., a conductive member) which is stickable or removable, such as a copper-foil tape, an aluminum-foil tape and the like. As shown in FIGS. 5, 8A, 8B and 9A, the conductive tapes 64*a*, 64*a* are respectively stuck at the opposite side ends of the second wiring member 122 which are parallel to each other in the longitudinal direction of the second wiring member 122 so as to be provided over the first and second conductive layers 41*a*, 41*b*. Since the conductive tape 64*a* is stickable on and removable from the second wiring member 122, the electrical conduction can be easily and reliably established and broken between the first and second conductive layers 41*a*, 41*b* respectively provided on the upper and lower surfaces of the second wiring member 122. When the first and second conductive layers 41*a*, 41*b* are electrically conducted to each other, the first common voltage wire 61 and the second common voltage wire 62 are electrically conducted to each other via the same layers 41*a*, 41*b* and the exposed portions.

The second common voltage wire 62 is provided to be grounded (e.g., to be connected to a ground). Therefore, when the first common voltage wire 61 and the second common voltage wire 62 are conducted to each other by conductor 64, an electric potential of the first common voltage wire 61 becomes equal to the ground. In a case in which the conductive tape 64*a* is adopted as the conductor 64, a widthwise dimension W of the conductive tape 64*a* (FIG. 8A) can be easily enlarged, or the first and second conductive layers 41*a*, 41*b* can be conducted, at a plurality of portions of the second wiring member 122, via a plurality of conductive tapes 64*a*. Thus, owing to the above-described arrangement, an impedance of a common voltage circuit is reduced, so that operations of the drive IC-chip 12*a* and the piezoelectric actuator 11 can be stabilized.

Figure 9A:
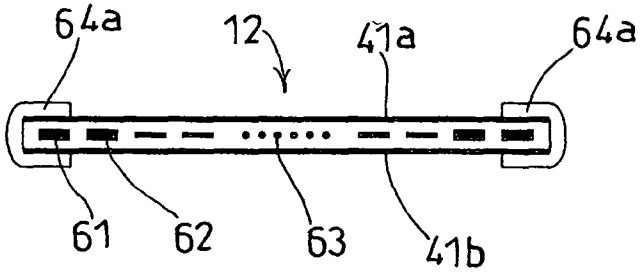
FIG. 9A is a side view showing the flexible wiring member, where a conductive tape is adopted as a conductor.
Figure 9B:
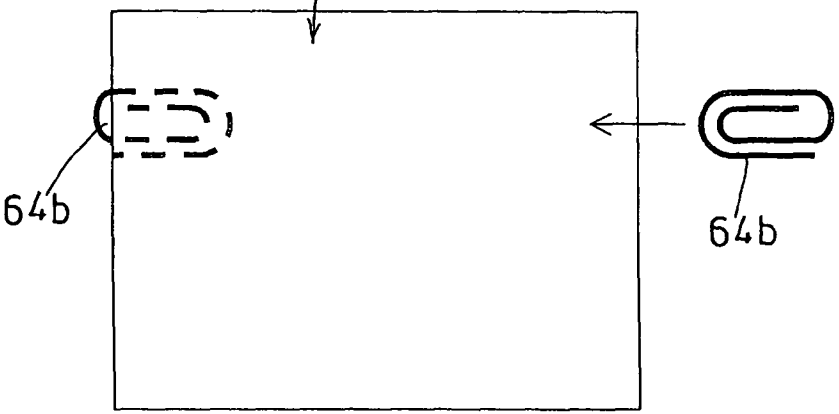
FIG. 9B is a plan view showing the flexible wiring member, where a conductive clip is adopted as a conductor.

As another example of the conductor 64, there may be adopted a conductive clip (i.e., a conductive member) which nips the first and second conductive layers 41*a*, 41*b* from the outside thereof. As shown in FIG. 9B, if a conductive paper clip 64*b* made of a metal is adopted as the clip, a space required for setting the conductor 64 can be reduced because a thickness of the conductive paper clip 64*b* is small. Further, the conductive paper clip 64*b* can be easily attached to and removed from the second wiring member 122. As compared to the conductive tape 64*a*, the conductive paper clip 64*b* can be repeatedly attached or removed again and again, thereby lowering cost required for the components.

It is noted that the conductor 64 (e.g., the conductive tape, the conductive paper clip, etc.) is preferably disposed, in the flexible wiring member 12, at a position away from a portion in which the piezoelectric actuator 11 is connected to the flexible wiring member 12, namely, at a position nearer to a portion in which the head-side circuit board 22 is connected to the flexible wiring member 12. As shown in FIG. 3, where the conductor 64 is attached to the flexible wiring member 12 at a position nearer to the portion in which the head-side circuit board 22 is connected thereto, the conductor 64 can be outwardly located or can be attached at a position so as to be easily reached by operator's hand from the outside. Therefore, the conductor 64 can be effectively and easily attached and removed even after the recording head 1 is assembled to the head holder 8.

Figure 9C:
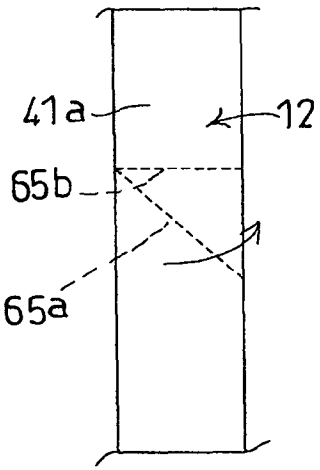
FIG. 9C through 9E are explanatory views explaining how to fold the flexible wiring member, where folding of the flexible wiring member is adopted as conducting means.
Figure 9D:
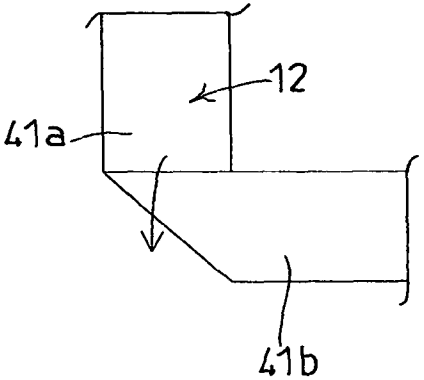
Figure 9E:
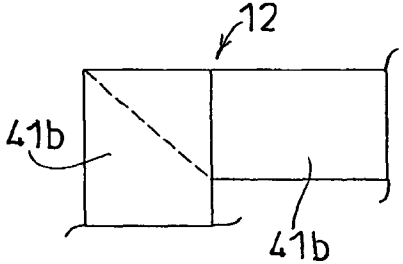

Other than the above-described conductor 64 such as the conductive tape and the conductive paper clip, there may be applied conducting means for establishing or breaking the electrical conduction between the first conductive layer 41*a* provided on the upper surface and the second conductive layer 41*b* provided on the lower surface. In this instance, a specific component like the conductor 64 may be not attached. Instead, as shown in FIG. 9E, the second wiring member 122 per se may be folded such that the first conductive layer 41*a* is superposed on the second conductive layer 41*b*. A manner for folding the second wiring member 122 are arbitrary, and the following is an exemplified process of the manner, as shown in FIGS. 9C through 9E: (i) initially, the second wiring member 122 is folded up according to a broken line 65*a* that is inclined by an angle of 45 degree with respect to the longitudinal direction of the second wiring member 122; (ii) substantially, the second wiring member 122 is further folded up according to a broken line 65*b* that extends in a direction perpendicular to the longitudinal direction of the second wiring member 122; (iii) as a result, the first and second conductive layers 41*a*, 41*b* respectively provided on the upper and lower surfaces of the second wiring member 122 can be superposed on each other, so that the electrical conduction is established therebetween. When the fold of the second wiring member 12 is released, the electrical conduction between the first and second conductive layers 41*a*, 41*b* can be broken. A final state may be a state (shown in FIG. 9E) in which the flexible wiring member 12 is folded so as to be right-angled in a plane view. Instead, the final state may be a state in which the second wiring member 122 is further folded so that the second wiring member 122 has a straight shape as a whole.

It is noted that a concept of a conductor and a concept of conducting means are partially overlapped with each other. Therefore, one form of the conductor may become one form of the conducting means, and vice versa. In the present embodiment, each of the above-described conductors (e.g., the conductive tape 64*a* and the conductive clip such as the conductive paper clip 64*b*) may be regarded as one form of the conducting means.

As a conductor or conducting means, there may be adopted another conductor wire which is attached by a conductive material (e.g., a solder, an adhesive, etc.) so that the first and second conductive layers 41*a*, 41*b* are connected to each other via the same wire. However, as compared to the conductive tape 64*a*, the conductive clip (e.g., the conductive paper clip 64*b*) and the above-described conducting means in which the flexible wiring member 12 is folded, the conductor wire is not easily attached and removed, thereby requiring a long time for the attachment or removal. Further, an operation of attaching or removing the conductor wire is complicated. Thus, it is not preferable to adopt the above-described another conductor wire as the conductor or the conducting means.

In the present embodiment, the first and second conductive layers 41*a*, 41*b* respectively provided in an entirety of the upper surface and an entirety of the lower surface of the second wiring member 122 are respectively connected to the first and second common voltage wires 61, 62 so as to be in parallel to each other. Therefore, the impedance of the common voltage circuit is reduced, so that the operations of the drive IC-chip 12*a* and the piezoelectric actuator 11 can be stabilized.

The conductive layers may be provided only in respective parts of a surface of the second wiring member 122. Further, if impedances of the first and second common voltage wires 61, 62 are low, the first and second conductive layers 41*a*, 41*b* may be omitted. In this case, the electrical conduction may be established, by the conductor or the conducting means, between the terminal portions of the first and second common voltage wires 61, 62 each being outwardly folded and exposed in the outer surface of the second wiring member 122 in the above-described manner.

In the present embodiment, each of the first and second common voltage wires 61, 62 is constituted by stacking two conductor wires. However, the number of the conductor wires constituting each of the first and second common voltage wires 61, 62 may be more than three, or may be just one. If each of the first and second common voltage wires 61, 62 is constituted by one conductor wire, the same wire may be divided at a plurality of positions in a widthwise direction thereof and a one of the portions of the wire is folded and externally routed so as to be connected to the conductor or the conducting means.

FIG. 10 shows an example of an electrical circuit adopted in the present embodiment. In the ink-jet recording apparatus 100, the body-side circuit board 90, the head-side circuit board 22 and the drive IC-chip 12*a* are connected to one another. The body-side circuit board 90 is equipped with a control circuit 93, a control-signal power source 94 and a drive-pulse power source 95. The drive IC-chip 12*a* is constituted by including a signal-converting circuit 96 and the drive-voltage-signal generating circuit 97.

The control circuit 93 is for outputting, to the signal-converting circuit 96, control signals such as enable, data, clock, strobe signals, based on suitable recording information. The control circuit 93 is connected to the signal-converting circuit 96 via the signal lines 63 (the signal wires 63) for controlling. The control-signal power source 94 is for applying a voltage, e.g., a voltage of 5 V, to the signal-converting circuit 96 and is connected to the signal-converting circuit 96 via the drive conductor line VDD1 for applying a drive voltage and the ground conductor line VSS1. The drive-pulse power source 95 is for applying a voltage, e.g., a voltage of 20 V, to the drive-voltage-signal generating circuit 97 and is connected to the same 97 via the drive conductor line VDD2 and the ground conductor line VSS2 (which corresponds to the second common voltage wire 62).

More specifically explained, the body-side circuit board 90 and the head-side circuit board 22 are connected via the flexible wiring member 99 including the drive conductor lines VDD1, VDD2, the ground conductor lines VSS1, VSS2, and the signal lines 63, which lines are arranged on a plane of the flexible wiring member 99. The drive IC-chip 12*a* mounted on the first wiring member 121 and the head-side circuit board 22 are connected via the second wiring member 122 including the above-described conductor lines and the conductor line VSS3 which corresponds to a common voltage line COM (i.e., the first common voltage wire 61) and which is connected to the external common terminal 44 of the piezoelectric actuator 11, which lines are arranged on a plane of the second wiring member 122.

On the head-side circuit board 22, an electrolysis capacitor 109 is bypass-connected between the drive conductor line VDD2 and the ground conductor line VSS2. The electrolytic capacitor 109 charges an electric charge to be supplied to the drive-voltage-signal generating circuit 97 and prevents an occurrence of a drop in a case where a large number of the operable portions of the piezoelectric actuator 11 are driven almost at the same time. Further, when the recording is normally performed, the electrical conduction is established, by the above-described conductor 64 or the conducting means, between the ground conductor line VSS2 (i.e., the second common voltage wire 62) and the conductor line VSS3 (i.e., the first common voltage wire 61) which is joined to the external common terminal 44 of the piezoelectric actuator 11. On the first wiring member 121 or in the drive IC chip 12*a*, the ground conductor line VSS2 and the ground conductor line VSS1 are connected to each other via a resistance R, whereby the drive-voltage-signal generating circuit 97 and the signal-converting circuit 96 are kept at the same voltage.

The signal-converting circuit 96 is for converting the control signals from the control circuit 93 into control signals that correspond to the respective nozzles and includes shift registers 106, D flip-flops 107, and gate circuits 108. The number of sets of the shift registers 106, D flip-flops 107, and gate circuits 108 is equal to the number of the nozzles. Among the control signals transmitted from the control circuit 93 via control-signal lines 63, the data signals and the clock signals are sent to the shift registers 106, the strobe signals are sent to the D flip-flops 107, and the enable signals are sent to the gate circuits 108. The data signals are serially transmitted from the control circuit 93, converted by the shift registers 106 into parallel signals corresponding to rows of the nozzles, and outputted from the D flip-flops 107 based on the strobe signals. Then the enable signals (i.e., the drive pulse signals) corresponding to the data signals are outputted from the gate circuits 108.

The drive-voltage-signal generating circuit 97 generates and outputs a drive pulse by converting, based on the voltage applied from the drive-pulse power source 95, each enable signal (i.e., the drive pulse signal) outputted from the corresponding gate circuit 108 into a signal having a voltage for driving the piezoelectric actuator 11. There are provided appropriate number of driver 110 (for example, 150 drivers) corresponding to the number of the nozzles.

In the thus constructed ink-jet recording apparatus 100, the voltage to be applied from the control-signal power source 94 is applied to the signal-converting circuit 96 via the drive conductor line VDD1, thereby normally driving the signal-converting circuit 96. The voltage to be applied from the drive-pulse power source 95 is applied to the drive-voltage-signal generating circuit 97 via the drive conductor line VDD2 and at the same time permits the electrolytic capacitor 109 disposed therebetween to be charged. When the ink is ejected, there is supplied a current from the electrolytic capacitor 109 to the drive-voltage-signal generating circuit 97 via the drive conductor line VDD2, so that a sufficient amount of the current is supplied to the piezoelectric actuator 11.

Figure 11:
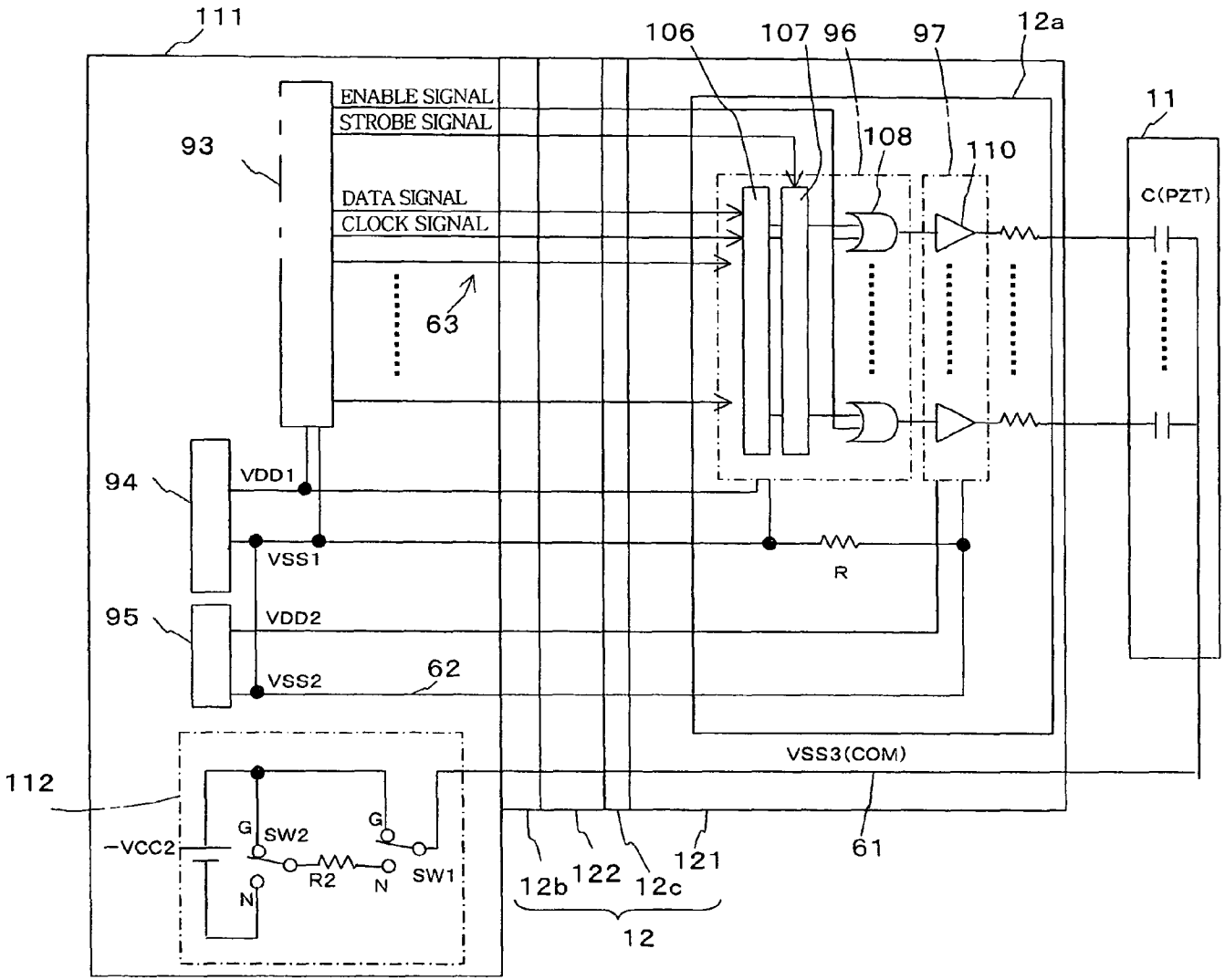
FIG. 11 is a diagram showing an example of an electrical circuit which is used when a polarization is performed.

In a manufacturing process of the recording head 1, the cavity portion 10 and the piezoelectric actuator 11 are stacked on each other, and the terminals (not shown) of the flexible wiring member 12 are respectively bonded, by a conductive material such as the solder, to the external individual terminal 43 and the external common terminal 44 of the piezoelectric actuator 11. Then, a piezoelectric layer of the piezoelectric actuator 11 is polarized. In a polarizing process, as shown in FIG. 11, a polarizing device 111, in place of the head-side circuit board 22, is connected to the terminal portion 12*b* of the flexible wiring member 12.

The polarizing device 111 includes a polarizing circuit 112 for generating a portion of polarizing electrical voltage and other electrical circuits for generating remaining portions of the electrical voltage. The above-described other electrical circuits are constituted by including the control circuit 93, the control-signal power source 94, and the drive-pulse power source 95 which are the equivalent of the body-side circuit board 90 for performing the above-described ink ejection. An operation of each of the control circuit 93, the control-signal power source 94 and the drive-pulse power source 95 has been described above, thus a detailed explanation of which is dispensed with.

The polarizing circuit 112 is connected to the conductor line VSS3 (i.e., the common voltage line COM or the first common voltage wire 61) which is joined to the common terminal that is common to all operable portions. Further, the polarizing circuit 112 includes a negative power source −VCC2, switches SW1, SW2 and a resistance R2.

When each operable portion (more specifically described, a piezoelectric material of each portion which is to function as the operable portion) is polarized, the first and second conductive layers 41*a*, 41*b* respectively provided on the upper and lower surfaces of the second wiring member 122 are not connected to each other by the conductor 64 or the conducting means, so that the ground conductor line VSS2 (i.e., the second common voltage wire 62) and the conductor line VSS3 (i.e., the common voltage line COM or the first common voltage wire 61) are not electrically connected to each other.

In a state in which the polarizing device 111 is connected to the flexible wiring member 12, both of the switches SW1, SW2 are positioned in a side G (i.e., a ground side), namely, in a side in which the negative power source −VCC2 and the conductive line VSS3 are not connected to each other. In this state, all of the drivers 110 are operated by the control circuit 93, the control-signal power source 94 and the drive-pulse power source 95 at the same time, thereby applying, to each operable portion, the same voltage (i.e., a voltage of V1) as a voltage applied when the ink is to be ejected. The electrical voltage in this state has the same value as that in the ink ejection, so that the polarization is not performed.

Next, both of the switches SW1, SW2 are moved to be positioned in a side N. In this state, a voltage of the negative power source −VCC2 (i.e., a voltage of −V2) is applied to each of the operable portions, and added to the applied voltage of V1. Thus, total voltage of (V1+V2) is applied to each of the operable portions, whereby the polarization is performed thereon. After the polarization has been completed, the polarizing device 111 is removed from the flexible wiring member 12.

When the recording head 1 is operated to perform the normal ink ejection, the conductor 64 is attached to the second wiring member 122. In this state, the electrical conduction is established between the first and second conductive layers 41*a*, 41*b* respectively provided on the upper and lower surfaces of the second wiring member 122, and the conductor line VSS3 (i.e., the common voltage line COM or the first common voltage wire 61) is connected to the ground conductor line VSS2 (i.e., the second common voltage wire 62), whereby the common electrode (i.e., the external common terminal 44) of the operable portions is grounded. Then, owing to the voltage (i.e., the voltage of V1) selectively applied to the external individual terminals 43 via the drive IC-chip 12*a*, the recording is performed by ejecting the ink from the desired nozzles of the recording head 1.

When there are measured an amount of static electricity of the piezoelectric actuator 11, a resistance value between each two of the operable portions, etc., for detecting a piezoelectric characteristic of the recording head 1, the conductor 64 or the conducting means is removed from the second wiring member 122. If the measurement is performed in a state in which the first and second voltage wires 61, 62 are joined to each other, a current via the drive IC-chip 12*a* is measured. This state causes a variation of consumption of the current of the drive IC-chip 12*a*, deteriorating an accuracy of the measurement. However, as described above, the measurement in the inspection of the recording head 1 can be accurately performed because the conductor 64 or the conducting means can be easily removed, and the normal ink ejection can be performed because the conductor 64 or the conducting means can be easily attached.

In the present embodiment, the piezoelectric actuator is used as the actuator. However, the present invention may be equally applied to an actuator in which an ink is ejected by being heated and boiled, when a resistance value of heat-resisting elements thereof is measured.

It is to be understood that the invention is not limited to the details of the illustrated embodiments, but may be embodied with various changes and modifications, which may occur to those skilled in the art, without departing from the spirit and scope of the invention defined in the attached claims.

What is claimed is:

1. A recording head, comprising:

an actuator including a plurality of operable portions operable to cause the recording head to perform a recording;

a drive circuit configured to drive the plurality of operable portions of the actuator;

a wiring member on which the drive circuit is mounted, which is joined to the actuator, and which has a plurality of conductor wires including a first common voltage wire connected to a common voltage portion of the actuator that is common to the plurality of operable portions and a second common voltage wire connected to a common voltage portion of the drive circuit, the recording head further comprising one of (A) a conductor configured to establish, in an outer surface of the wiring member, an electrical conduction between the first common voltage wire and the second common voltage wire and (B) conducting means configured to establish, in the outer surface of the wiring member, the electrical conduction between the first common voltage wire and the second common voltage wire wherein each of the first common voltage wire and the second common voltage wore is disposed inside of the wiring member and has an exposed portion exposed from the wiring member, and wherein said one of the conductor and the conducting means is configured to establish the electrical conduction between the first common voltage wire and the second common voltage wire via the exposed portion, wherein the wiring member includes a first conductive layer and a second conductive layer which are provided by the outer surface of the wiring member and which are respectively electrically connected to the exposed portion of each of the first common voltage wire and the second common voltage wire, and wherein said one of the conductor and the conducting means is configured to establish the electrical conduction between the first common voltage wire and the second common voltage wire via the first conductive layer and the second conductive layer.

2. The recording head according to claim 1, the exposed portion of each of the first common voltage wire and the second common voltage wire is formed by folding, in one of (a) one of opposite end portions of the wiring member in a longitudinal direction thereof, (b) the other of the opposite end portions thereof, and (c) an intermediate portion intermediate between the opposite end portions thereof, a part of a corresponding one of the first common voltage wire and the second common voltage wire so as to be exposed in an outside of the wiring member.

3. The recording head according to claim 1, wherein the wiring member includes: a first wiring member on which the drive circuit is mounted and which is joined to the actuator; and a second wiring member which is joined, at one of opposite end portions thereof, to the first wiring member, and wherein the exposed portion of each of the first common voltage wire and the second common voltage wire is disposed in one of (i) said one of the opposite end portions of the second wiring member and (ii) the other of the opposite end portions thereof.

4. The recording head according to claim 1, wherein the electrical conduction between the first and second common voltage wires are established by the conductor, and wherein the conductor includes a conductive member attached over the first conductive layer and the second conductive layer.

5. The recording head according to claim 1, wherein the electrical conduction between the first and second common voltage wires are established by the conductor, and wherein the conductor includes a conductive tape adhered over the first conductive layer and the second conductive layer.

6. The recording head according to claim 1, wherein the electrical conduction between the first and second common voltage wires are established by the conducting means, and wherein the wiring member has a flexible band-like shape and has a configuration permitting the wiring member to be folded such that the first conductive layer and the second conductive layer are held in close contact with each other, and wherein the conducting means is provided by the configuration of the wiring member.

7. The recording head according to claim 1, wherein the first conductive layer is provided in one of opposite surfaces of the wiring member, and the second conductive layer is provided in the other of opposite surfaces of the wiring member.

8. The recording head according to claim 7, wherein the electrical conduction between the first and second common voltage wires are established by the conductor, and wherein the conductor includes a conductive member attached over the first conductive layer and the second conductive layer.

9. The recording head according to claim 7, wherein the electrical conduction between the first and second common voltage wires are established by the conductor, and wherein the conductor includes a conductive tape adhered over the first conductive layer and the second conductive layer.

10. The recording head according to claim 7, wherein the electrical conduction between the first and second common voltage wires are established by the conductor, and wherein the conductor includes a conductive clip which nips the wiring member so as to contact both of the first conductive layer and the second conductive laver.

11. The recording head according to claim 7, wherein the electrical conduction between the first and second common voltage wires are established by the conducting means, and wherein the wiring member has a flexible band-like shape and has a configuration permitting the wiring member to be folded such that the first conductive layer and the second conductive layer are held in close contact with each other, and wherein the conducting means is provided by the configuration of the wiring member.

12. The recording head according to claim 1, wherein the plurality of conductor wires include a pair of first common voltage wires each as the first common voltage wire, a pair of second common voltage wires each as the second common voltage wire, and a plurality of signal wires for controlling operations of the plurality of operable portions of the actuator independently of each other, and wherein the pair of first common voltage wires and the pair of second common voltage wires are respectively disposed at opposite side end portions of the wiring member in its widthwise direction, and the plurality of signal wires are disposed therebetween.

13. The recording head according to claim 12, wherein the pair of second common voltage wires arc disposed inside the pair of first common voltage wires in a direction in which the opposite side end portions of the wiring member are opposite to each other in its widthwise direction.

14. The recording head according to claim 1, wherein one of the first common voltage wire and the second common voltage wire is grounded.

15. The recording head according to claim 1, wherein the wiring member is joined, at one of opposite end portions thereof, to the actuator, and wherein said one of the conductor and the conducting means is disposed at a position nearer to the other of the opposite end portions of the wiring member at which the wiring member is not joined to the actuator, than to the one of the opposite end portions of the wiring member.

16. The recording head according to claim 1, wherein the wiring member is joined, at one of opposite end portions thereof, to the actuator, and is not joined, at the other of the opposite end portions, to the actuator wherein the drive circuit s mounted on the wiring member at an intermediate portion thereof intermediate between the one of the opposite end portions and the other of the opposite end portions, and wherein said one of the conductor and the conducting means is disposed at a position between the other of the opposite end portions of the wiring member and the drive circuit.

17. A method for inspecting the recording head defined in claim 1, comprising:

breaking the electrical conduction between the first common voltage wire and the second common voltage wire established by said one of the conductor and the conducting means;

detecting a characteristic of the actuator via the first common voltage wire after the electrical conduction is broken, so as to inspect the recording head; and establishing, by said one of the conductor and the conducting means, the electrical conduction between the first common voltage wire and the second common voltage wire in the wiring member after the characteristic of the actuator is detected.

18. A method for manufacturing the recording head defined in claim 1, comprising:

preparing the wiling member which is joined to the actuator and without the electrical conduction being established in the wiring member; polarizing the plurality of operable portions of the actuator by applying a voltage via the first common voltage wire for the wiring member which has been prepared; and establishing, by said one of the conductor and the conducting means, the electrical conduction between the first common voltage wire and the second common voltage wire in the wiring member after the polarization has been performed.

* * * * *